United States Patent [19]

Mikesell

[11] Patent Number: 5,060,911

[45] Date of Patent: Oct. 29, 1991

[54] HAMMER WITH NAIL-PULLING LEVER ARM AND FULCRUM EXTENSION

[76] Inventor: Jerome J. Mikesell, 3750 N. Lake Shore Dr., Chicago, Ill. 60613

[21] Appl. No.: 616,383

[22] Filed: Nov. 21, 1990

[51] Int. Cl.[5] ..... B25C 11/00

[52] U.S. Cl. ..... 254/26 E

[58] Field of Search ..... 254/26 E, 26 R, 27

[56] References Cited

U.S. PATENT DOCUMENTS

| | | | |
|---|---|---|---|
| 540,967 | 6/1895 | Evelth . | |
| 671,821 | 4/1901 | Gagnon | 254/26 R |
| 2,589,046 | 3/1952 | Brown et al. | 254/26 E |
| 2,589,047 | 3/1952 | Brown et al. . | |
| 2,747,835 | 5/1956 | Belgard . | |
| 4,422,620 | 12/1983 | Nitzberg | 254/26 E |
| 4,998,996 | 3/1991 | Belanger | 254/26 E |

*Primary Examiner*—Robert C. Watson

*Attorney, Agent, or Firm*—Hill, Van Santen, Steadman & Simpson

[57] ABSTRACT

A claw hammer includes a fulcrum repositioning and/or lever arm lengthening extension which may be releasably mounted at the distal, hammer head, end of the hammer for use in pulling nails and also releasably mounted at the proximal end of the hammer handle for storage.

30 Claims, 2 Drawing Sheets

FIG. 7
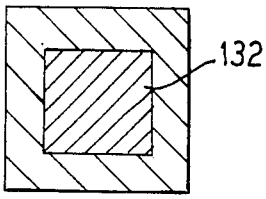
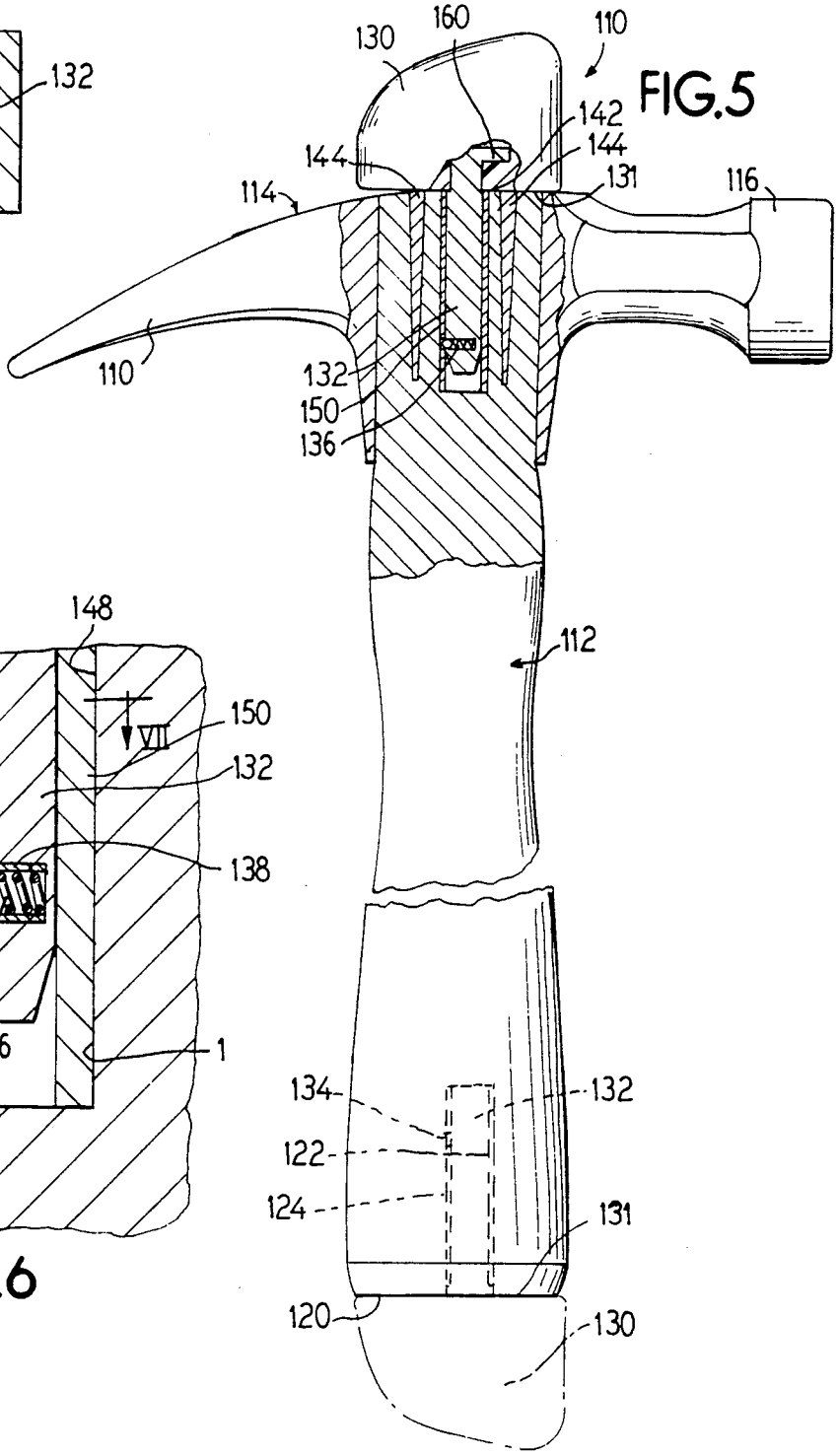
FIG. 5
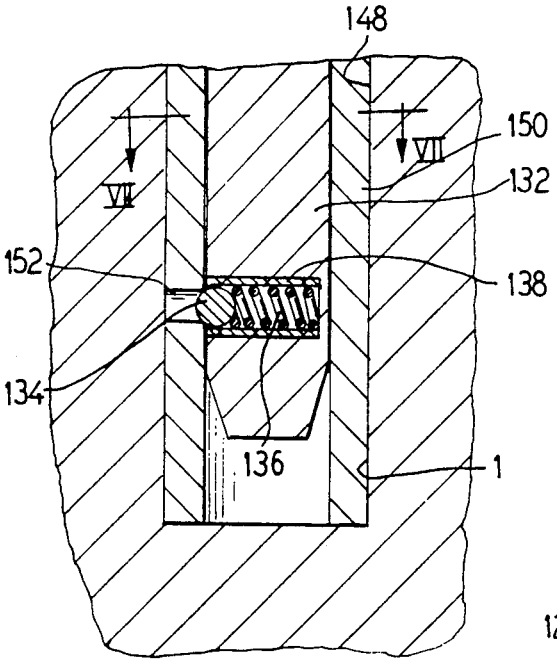
FIG. 6

HAMMER WITH NAIL-PULLING LEVER ARM AND FULCRUM EXTENSION

BACKGROUND OF THE INVENTION

1. Field of the Invention

The present invention relates to hammers, and is more particularly concerned with the provision of a fulcrum extension for pulling nails, the fulcrum extension being releasably engageable at the distal end of the hammer and, during periods of non-use, being advantageously stored out-of-the-way at the proximal end of the hammer.

2. Description of the Prior Art

Many implements have been used over the years for displacing the fulcrum and/or increasing the lever arm of a hammer for pulling nails. Most often the practice is to place a block of wood beneath the hammer head to displace the fulcrum and therefore increase the length of the lever arm. Many times, however, a block of wood or the like is not readily available.

McC. Eveleth in his U.S. Pat. No. 540,967 discloses the use of a fulcrum cushion carried on a toothed extensible member which is movable through a hammer head and hammer handle. The handle is provided with a pivotal spring-loaded latch member having a dog at one end extending through the hammer handle and into a position between the teeth of the extensible member. The extensible member thus may be moved to reposition the fulcrum outwardly from the surface of the hammer head to a plurality of selected positions as determined by the length of the extensible member and the number and spacing of the teeth thereon. The plunger or extensible member is spring loaded so that release of the latch will move the extensible member and its cushion outwardly of the hammer until the latch is permitted to engage.

U.S. Pat. No. 1,408,162 of Bartosc discloses a hammer which has a T-shaped element located therein with the base of the T mounted on a screw in the hammer head so that it is adjustable by way of a knurled nut or thumb wheel, again to move the crossbar of the T, as a fulcrum, outwardly from the head of the hammer.

Brown, et al in their U.S. Pat. No. 2,589,047 disclose an insert-type member for a hammer head which is of a U-shaped structure to fit in complementary wide grooves in the hammer head and which is movable outwardly and rotatable by 90° for fixation in a groove transverse of the hammer head, again for moving the fulcrum outwardly from the surface of the hammer head.

U.S. Pat. No. 2,747,835 to Belgard discloses an attachment for a hammer head in which a member has a first surface which is complementary to the curvature of the hammer head for resting thereagainst and a second surface, spaced from the first surface, which has a more pronounced curvature, and which is to be used as a repositioned fulcrum. The member is attached to the hammer head by a pair of U-shaped straps, one of the straps embracing the peen section of the hammer head while the other embraces the claw section of the hammer head. The U-shaped straps are attached to the member by screws.

The above structures are basically representative of the art and disclose attachments or supplements to hammer heads which require multiple moving parts which, in some cases, complicate the structure of a hammer, and in all cases add elements which are permanently fixed to the distal end of the hammer and, therefore, increase the weight in the area of the hammer head, in order to have a lever arm increase readily available.

SUMMARY OF THE INVENTION

It is the object of the present invention to provide apparatus for displacing the fulcrum of a hammer while not permanently increasing the weight of the hammer head and, at the same time, having the fulcrum extension structure handy and readily available in that it is stored on the hammer, in particular at the proximal end of the hammer handle.

The above object is achieved, according to the present invention, by providing what is basically a standard claw hammer with the standard claw hammer head at the distal end of a handle. The proximal end of the handle carries an extension base fulcrum member which is shaped to match the distal end of the hammer head and including an arcuate surface which is shaped for easy rocking action in pulling nails. The extension base is therefore advantageously somewhat rounded to provide a smooth transition during nail pulling.

A first pin is provided for releasably securing the extension base to either the distal end or the proximal end of the hammer handle. This first pin carries a latch, here disclosed as a single captured, yieldable latch element or as a pair of captured, yieldable latch elements, such as spring-loaded balls, adjacent the free end thereof. The latch elements are pressed inwardly upon insertion of the first pin into a sleeve mounted in another bore in the proximal end of the handle or in a corresponding sleeve mounted in a similar bore at the distal end of the hammer handle. These sleeves are basically identical and of the same length such that when the first pin passes through and past the end of the sleeve or to a semispherical detent therein and the latch element or elements are moved outwardly in response to the spring force, the surface of the extension base is flush against either the proximal surface of the hammer handle or the distal surface of the hammer handle. Other latches, such as a split pin carrying detent projections or hollow arcuate ended cylinders, may also be used. When a single latch element is used, the circumferential orientation of the semispherical detents act as locators for proper alignment of the arcuate fulcrum surface.

A second pin may also be provided as a locator pin to be received in a cooperating bore in the distal end of the handle during use of the base for pulling nails, and in a corresponding bore in the proximal end of the hammer handle during storage of the extension base, the locator pin aligning the arcuate fulcrum surface and preventing rotation of the extension base during use and during storage. Also, a spring-loaded ball in the extension base and a detent in the proximal and distal end surfaces of the hammer may be used as locators.

Due to the identical bores and sleeves provided in the proximal and distal ends of the hammer handle, the extension base may be readily removed from the storage position and placed in the working position or removed from the working position and placed into the storage position so that an extension of the lever arm by displacement of the fulcrum is always handy and readily available to the worker.

BRIEF DESCRIPTION OF THE DRAWING

Other objects, features and advantages of the invention, its organization, construction and operation will be best understood from the following detailed description, taken in conjunction with the accompanying drawings, on which:

FIG. 5 is a partially-sectionalized view of a claw hammer including and constructed in accordance with another embodiment of the invention;

FIG. 6 is an enlarged and more detailed view of a portion of FIG. 5 showing the other embodiment of the invention; and FIG. 7 is a sectional view taken along the parting line VII—VII of FIG. 6.

DESCRIPTION OF THE PREFERRED EMBODIMENT

Figure 1:
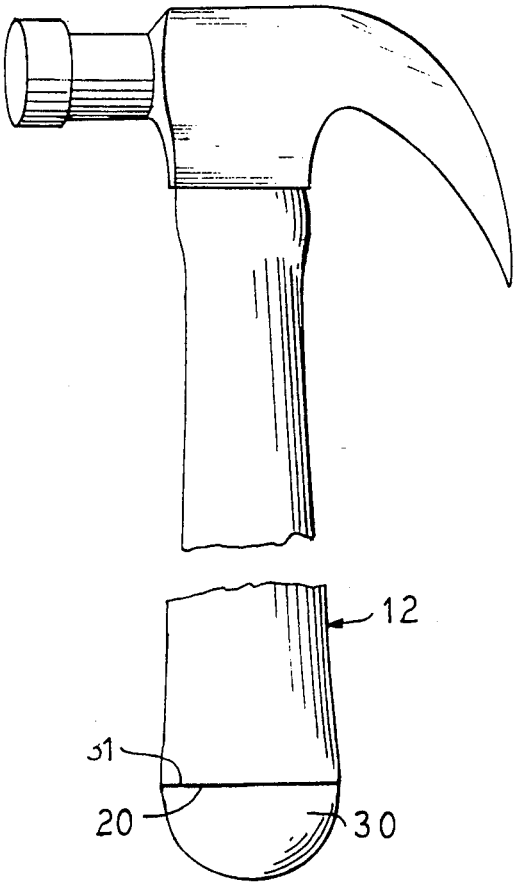
FIG. 1 is a basic elevation and somewhat perspective view of a claw hammer constructed in accordance with the present invention.
Figure 2:
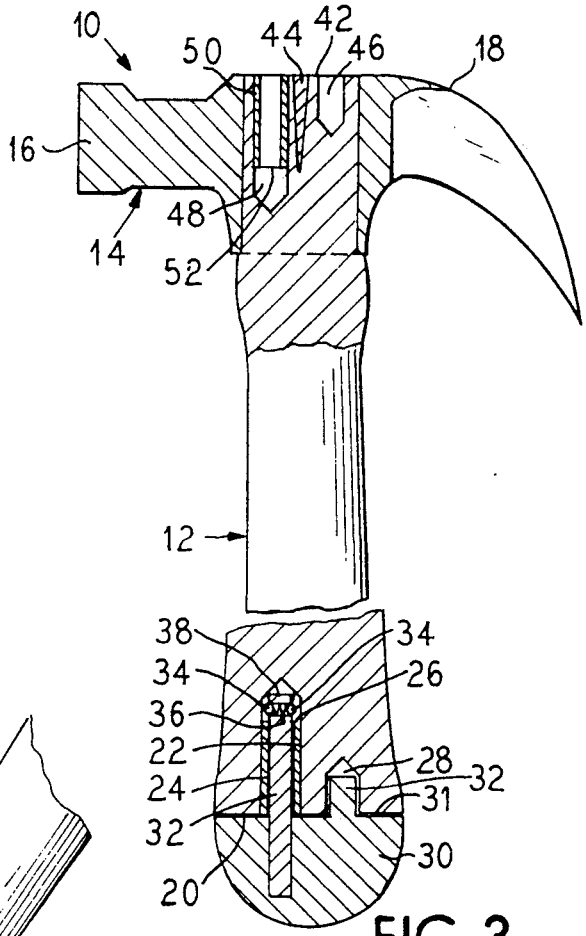
FIG. 2 is a partially-sectionalized view of a hammer constructed in accordance with the present invention taken along the plane of FIG. 1 between the two claws and illustrating the latching structure including double bore and sleeve structure of the proximal and distal ends of the hammer handle.
Figure 4:
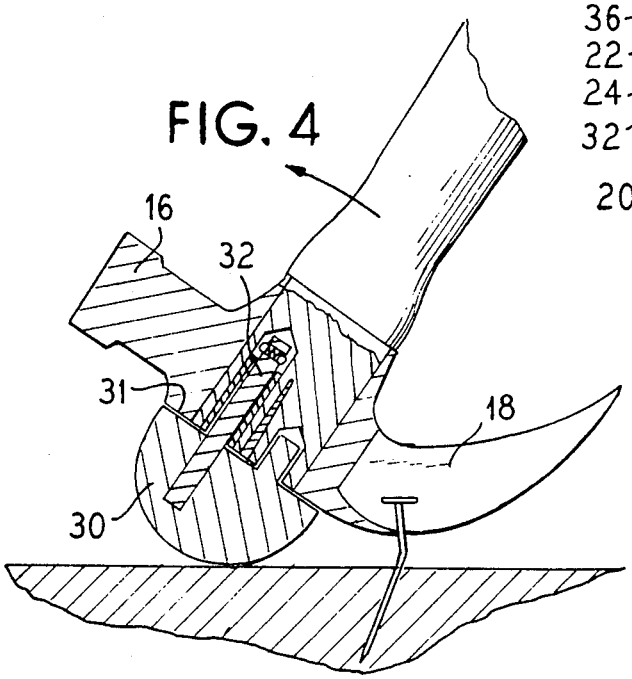
FIG. 4 is a sectional view showing the hammer fulcrum extension mounted and in use pulling a nail and wherein the latch structure includes a pair of spring-loaded balls.

Referring to the drawing, a hammer constructed in accordance with the present invention is generally illustrated at 10 as comprising a handle 12 of wood, glass fiber composition or the like carrying a hammer head 14. As is conventional, the hammer head 14 is illustrated as including a peen section 16 and a claw section 18 and is retained on the handle 12 by a force fit and the provision of a retention wedge 44, and as is also conventional, the distal end of the handle 12 and the surrounding portion of the hammer head 14 together serve as a fulcrum when pulling nails.

At the proximal end, the hammer handle 12 includes a proximal surface 20 which has a surface 31 flush thereagainst of a fulcrum extension base 30 of wood, glass fiber composition or the like. The proximal end of the hammer handle 12 also includes a bore 22 including a metal sleeve 24 press fit therein. The sleeve 24 includes a distal end 26 which, as will be appreciated from the discussion below, serves as a portion, i.e. a shoulder, of a latching mechanism for the fulcrum extension base 30.

The proximal end of the hammer handle 12 also includes a bore 28 therein as a locator bore which, as will also be appreciated from the discussion below, serves to prevent rotation of the fulcrum extension base 30.

Figure 3:
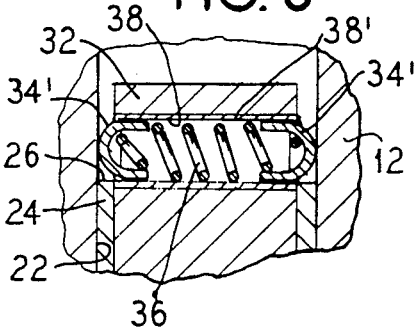
FIG. 3 is an enlarged and more detailed view of one embodiment of the latching structure of FIG. 2 including latch elements having respective arcuate or spherical portions.

The fulcrum extension base 30 includes a pin 32 press fit, screwed or molded therein (see FIG. 5) which, near its distal end, carries a pair of balls 34 which are captured in a bore 38 and loaded outwardly by way of a spring 36. In FIG. 3, the latch members are illustrated as hollow arcuate-ended cylinders 34' and the bore 38 is supplemented with a sleeve 38'. If balls 34' are used, the bore 38, or more specifically the sleeve 38', will have a reduced diameter at its ends to capture the balls. Hollow semi-spheres or arcuate-ended cylinders 34' will provide a greater distance vis-a-vis the balls for locating the spring and holding the latches captive. An alternative is a split, resilient pin having projections at the location of and in place of the pair of balls 34 or the cylinders 34'.

As is evident, when the pin 32 is pushed into the sleeve 24, the latches 34 or 34' are pressed inwardly against the force of the spring 36 until the balls 34 pass the distal end 26 of the sleeve 24. The latches 34 or 34' then move outwardly against the spring force built up in the spring 36 to releasably latch the fulcrum extension base 30 in place with its surface 31 flush against the proximal surface 20 of the hammer handle 12.

During the movement of the pin 32 through the sleeve 24, a locator pin in the form of a projection 40 extending from the surface 31 of the fulcrum extension base 30 is aligned with and received in the bore 28 so that the fulcrum extension base 30 is prevented from rotating while the same is stored at the proximal end of the hammer handle 12.

When it is necessary to improve the leverage of a worker in pulling a nail, the fulcrum extension base 30 is removed from the proximal end of the hammer handle 12 by exerting a pull thereon to again cause the sleeve 24 to force the latches 34 or 34' into the bore 38 (or sleeve 38') so that the pin 32 may be retracted from the sleeve 24. The fulcrum extension base 30 is then inverted and reattached at the distal end of the hammer handle 12 via a locator bore 46 for receiving the locator pin 31 and via a sleeve 50 press fit in a bore 48, the bore 46, the bore 48 and the sleeve 50 being identical to the bore 28, the bore 22 and the sleeve 24. The sleeve 50 also includes an end 52 similar to the end 26 which is spaced from the proximal surface 42 of the proximal end a distance such that the latches 34 or 34' move outwardly under the force of the spring 36 to latch against the end 52 when the fulcrum extension base 30 is in place with its surface 31 flush against the surface 42 of the proximal end of the hammer handle 12.

Referring to FIGS. 5–7, another embodiment of the invention is illustrated. FIG. 5 shows a hammer 110 comprising a hammer handle 112 of wood, glass fiber composition or the like and carrying a hammer head 114. Again, and as is conventional, the hammer head 114 is illustrated as including a peen section 116 and a claw section 118 and is retained on the handle 112 by a force fit and by the provision of a pair of retention wedges 144. Again, and as is also conventional, the distal end of the handle 112 and the surrounding portion of the hammer head 114 together serve as a rocker-type fulcrum for pulling nails.

At its proximal end, the hammer handle 112 includes a proximal surface 120 which, as shown in phantom, has a surface 131 flush thereagainst of a fulcrum extension base 130, again of wood, glass fiber composition or the like. The proximal end of the hammer handle 112 also includes a bore 122 including a metal sleeve 124 press fit therein. The sleeve 124 may include a distal end 126 (not shown) as in the previous embodiment for latching. However, latching in this embodiment is provided by a different mechanism, as is locating, which is provided by the same mechanism. Due to the reduction in the number of parts, therefore, this is the preferred embodiment of the invention.

The fulcrum extension base 130, as before, includes a pin 132 press fit, screwed or molded therein (see FIG. 5) which, near its distal end, carries a ball 134 (see FIG. 6)

captured in a bore, here constituted by a sleeve 138 and loaded outwardly by way of a spring 136. The ball 134 is held captive by a turn-in end 152 of the sleeve 138. As in the embodiment of FIG. 3, the ball 134 may be replaced by a hollow tubular section having a hemispherical end.

As with the first embodiment, when the pin 132 is pressed into the sleeve 124, the latch member 134 is pressed inwardly against the force of the spring 136 until the latch member 134 moves to enter a latch member in the form of a detent 152, which also be constituted by a bore through the wall of the sleeve as shown in FIG. 6. The structure of the latching mechanism at the proximal end of the handle in FIG. 5 is identical to the structure of FIG. 6, but inverted.

Anti-rotation of the fulcrum extension base 130 may be provided by a non-circular cross section of the elements, such as the square cross section illustrated in FIG. 7. Proper location is attained by providing a single latch on the pin 132 to be received in a single latch on the sleeve 124 or the sleeve 150. Therefore, when using a round cross section for the pin, the proper locating and anti-rotating features may still be provided by the use of a single latch member on the pin and a single cooperating latch member on the sleeve.

When the latches are engaged, the surface 131 of the fulcrum extension base 130 is flush against the selected proximal end surface 120 or distal end surface 142.

As before, when it is necessary to improve the leverage of a worker in pulling a nail, the fulcrum extension base 130 is removed from the proximal end of the hammer handle 112 by exerting a pull thereon to again cause the sleeve 124 to force the latch 134 back into the sleeve 138 so that the pin 132 may be retracted from the sleeve 124. The fulcrum extension base 130 is then inverted and reattached at the distal end of the hammer handle 112 via the sleeve 150 which is press fit in the bore 148.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A hammer comprising:

an elongate handle including a distal end having a distal surface and a proximal end having a proximal surface;

a hammer head mounted at said distal end and including an end surface including said distal surface of said handle therein and also acting as a fulcrum for pulling nails, and a nail-pulling claw;

a first bore in said distal end extending into said handle from and substantially perpendicular to said distal surface;

a first spherical recess in said bore spaced a predetermined distance from said distal surface;

a second bore extending into said handle from and substantially perpendicular to said proximal surface;

a second spherical recess in said second bore spaced said predetermined distance from said proximal surface; and a fulcrum extension member including a first surface, a fulcrum surface, and an attachment pin extending from said fulcrum extension member generally perpendicular to said first surface, said attachment pin including a free end to be selectively received in said first bore to mount said body at said distal end to essentially lengthen said handle and move said fulcrum from said distal end surfaces to said fulcrum surface of said extension member, and in said second bore to store said fulcrum extension member at said proximal end of said handle, said pin including at least one yieldable member at said free end spaced said predetermined distance from said first surface to be received in and releasably latch in the respective spherical recess of the respective bore.

2. The hammer of claim 1, and further comprising:

a sleeve in said first bore and including said first spherical recess therein.

3. The hammer of claim 1, and further comprising:

a sleeve in said second bore and including said second spherical recess therein.

4. The hammer of claim 1, and further comprising:

first and second sleeves respectively mounted in said first and second bores and each including a respective one of said spherical recesses therein for receiving said at least one yieldable member.

5. The hammer of claim 1, wherein:

said at least one yieldable member comprises a spherical element held captive in said pin, and spring means urging said spherical element radially outwardly.

6. A hammer comprising:

an elongate hammer handle including a distal end having a distal surface and a proximal surface having a proximal surface;

a hammer head mounted at said distal end of said elongate hammer handle and including a fulcrum section and a claw section for pulling nails;

a first bore extending into said distal end from said distal surface;

a first sleeve mounted in said first bore and including a first latch element spaced from said distal surface;

a second bore extending into said proximal end from said proximal surface;

a second sleeve mounted in said second bore and including a second latch element spaced from said proximal surface; and a fulcrum extension member adapted to be selectively mounted at said distal end and at said proximal end of said hammer handle, said fulcrum extension member including a first surface, an arcuate fulcrum surface, a pin extending from said first surface to be received in said first sleeve such that said first surface engages said distal surface and said arcuate fulcrum surface is positioned beyond said distal end to replace said fulcrum section as the fulcrum, and to be received in said second sleeve such that said first surface engages said proximal surface to store said fulcrum extension member at said proximal end of said hammer handle, a locator means on said pin to be received in a respective latch element to releaseable mount said fulcrum extension member to said hammer handle and prevent rotation of said fulcrum extension member about said first pin, said locator means including at least one yieldable releasable latch member carried by said pin for resilient, yieldable bypassing through the respective sleeve and latching against the respective latch element of the respective sleeve.

7. In a hammer of the type which comprises a hammer head mounted on the distal end of an elongate hammer handle and which includes a claw for pulling nails using the hammer hed as a fulcrum, in which the handle between the distal end and the proximal end of the handle serves as a lever arm, and which includes an appliance to be mounted at the distal end to serve as a repositioned fulcrum and extend the length of the lever arm, the improvement comprising:

first and second latch means including respective first and second anti-rotation means respectively mounted in the handle adjacent the distal and proximal ends of the handle; and third latch means on said appliance including third anti-rotation means for selective engagement with said first and second anti-rotation means, releasably engageable selectively and separately, with said first and second latch means to selectively detachably and anti-rotationally mount the appliance at the distal end for use as a repositioned fulcrum in pulling nails and at the proximal end for storage.

8. In a hammer of the type which comprises a hammer head mounted on the distal end of an elongate hammer handle and which includes a claw for pulling nails using the hammer head as a fulcrum, in which the handle between the distal end and the proximal end of the handle serves as a lever arm, and which includes an appliance to be mounted at the distal end to serve as a repositioned fulcrum and extend the length of the lever arm, the improvement comprising:

a pin extending from the appliance and including a free end having a non-circular cross section, and a first latch member adjacent said free end; and first and second bore means in the distal and proximal ends, respectively, of the handle, each of said bore means selectively receiving said pin and including a complementary cross section with respect thereto to prevent rotation of the appliance and a releasable second latch member cooperable with said first latch member to releasably latch the appliance to the respective end of the handle.

9. A hammer comprising:

an elongate handle including a distal end and having a distal surface and a proximal end having a proximal surface;

a hammer head mounted at said distal end and including an end surface acting as a fulcrum and a nail-pulling claw;

a first bore in said distal end extending into said handle from and substantially perpendicular to said distal surface;

a first shoulder in said first bore facing away from said distal surface;

a second bore extending into said handle from and substantially perpendicular to said proximal surface;

a second shoulder in said second bore facing away from said proximal surface; and a fulcrum extension member including a first surface, a fulcrum surface, and an attachment pin extending from said fulcrum extension member generally perpendicular to said first surface, said attachment pin including a free end to be selectively received in said first bore to mount said body at said distal end to essentially lengthen said handle and move said fulcrum from said end surface to said fulcrum surface of said extension member, and in said second bore to store said fulcrum extension member at said proximal end of said handle, and said pin including at least one yieldable member adjacent said free end to releasably latch against the respective shoulder of the respective bore.

10. The hammer of claim 9, and further comprising:

a sleeve in said first bore and including an end serving as said first shoulder.

11. The hammer of claim 9, and further comprising:

a sleeve in said second bore and including an end serving as said second shoulder.

12. The hammer of claim 9, and further comprising:

first and second sleeves respectively mounted in said first and second bores and each including an end serving as the respective shoulder.

13. The hammer of claim 9, wherein:

said at least one yieldable member comprises a pair of spherical elements held captive in said pin, and spring means between and urging said spherical elements radially outwardly.

14. The hammer of claim 9, wherein:

said at least one yieldable member comprises a pair of spring-loaded balls held captive in said pin, and spring means between and urging said balls radially outwardly.

15. The hammer of claim 9, and further comprising:

a first locator bore extending into said distal end of said handle substantially perpendicular to said distal surface; a second locator bore extending into said proximal end of said handle substantially perpendicular to said proximal surface; and a locator pin extending from said fulcrum extension member generally perpendicular to said first surface to be selectively received in said first and second locator bores to prevent rotation of said fulcrum extension member about said attachment pin.

16. A hammer comprising:

an elongate hammer handle including a distal end having a distal surface, and a proximal surface having a proximal surface;

a hammer head mounted at said distal end of said elongate hammer handle and including a fulcrum section and a claw section for pulling nails;

a first bore extending into said distal end from said distal surface;

a first sleeve mounted in said first bore and including a first end spaced a predetermined distance from said distal surface;

a first locator bore extending into said distal end from said distal surface;

a second bore extending into said proximal end from said proximal surface;

a second sleeve mounted in said second bore and including a second end spaced said predetermined distance from said proximal surface;

a second locator bore extending into said proximal end from said proximal surface; and a fulcrum extension member adapted to be selectively mounted at said distal end and at said proximal end of said hammer handle, said fulcrum extension member including a first surface, an arcuate fulcrum surface, a first pin extending from said first surface to be received in said first sleeve such that said first surface engages said distal surface and said arcuate fulcrum surface is positioned beyond said distal end to replace said fulcrum section as the fulcrum, and to be received in said second sleeve such that said first surface engages said proximal surface to store said fulcrum extension member at said proximal end of said hammer handle, a locator pin spaced from said first pin and extending from said first surface to be received in a respective one of said first and second locator bores to prevent rotation of said fulcrum extension member about said first pin, and at least one yieldable releasable latch member carried by said first pin spaced said predetermined distance from said first surface for resilient, yieldable bypassing through the respective sleeve and latching against the respective end of the respective sleeve.

17. The hammer of claim 16, wherein:

said distal, proximal and first surfaces are essentially flat; and said arcuate fulcrum surface includes two ends joined by said first surface.

18. The hammer of claim 16, wherein:

said first and second sleeves are press fit and frictionally engage in said first and second bores, respectively.

19. The hammer of claim 16, wherein:

said at least one yieldable, releasable latch member comprises a transverse bore through said first pin, a pair of latch elements each including a spherical portion for extension beyond the surface of said first pin, said latch elements held captive in said transverse bore, and a spring in said transverse bore normally urging said latch elements outwardly such that said spherical portions extend transversely beyond the surface of said first pin to engage and be deflected by the respective sleeve.

20. In a hammer of the type which comprises a hammer head mounted on the distal end of an elongate hammer handle and which includes a claw for pulling nails using the distal end and the claw as a fulcrum, in which the handle between the distal end and the proximal end of the handle serves as a lever arm, and which includes an appliance to be mounted at the distal end to serve as a repositioned fulcrum and to extend the length of the lever arm, the improvement comprising:

first and second latch means respectively mounted in the handle adjacent the distal and proximal ends of the handle; and third latch means on said appliance, releasably engageable selectively and separately, with said first and second latch means to selectively detachably mount the appliance at the distal end for use as a repositioned fulcrum in pulling nails and at the proximal end for storage.

21. The improved hammer of claim 20, wherein:

each of said first and second latch means comprises an opening in the respective end of the handle and including a latch shoulder therein; and said third latch means comprises a pin to be received in a selected one of said openings and carrying a resilient latch to engage against the respective latch shoulder.

22. The improved hammer of claim 21, wherein the improvement is further defined as comprising:

a pair of locator bores each in a respective end of the handle; and a locator pin included in and extending from the appliace to be received in a respective locator bore to prevent rotation of the appliance about said third securing means.

23. The improved hammer of claim 21, wherein:

each of said openings comprises a bore and a sleeve mounted in said bore and including an end serving as the respective latch shoulder.

24. The improved hammer of claim 23, wherein:

said third latch means comprises a transverse bore in said pin, at least one latch element including an arcuate portion held captive in said transverse bore such that said arcuate portion thereof may extend radially beyond said pin, and spring means biasing said at least one latch element radially outwardly, said latch element being urged inwardly against the bias of said spring means by a respective one of said sleeves and latch biased by said spring means over the respective sleeve end upon passing through the respective end of the respective sleeve and over the respective end thereof upon mounting of the appliance at either end of the handle.

25. In a hammer of the type which comprises a hammer head mounted on the distal end of a hammer handle and which includes a claw for pulling nails using the distal end and the claw as a fulcrum, in which the handle between the distal end and the proximal end of the handle serves as a lever arm, and which includes an appliance to be mounted at the distal end to serve as a repositioned fulcrum and to extend the length of the lever arm, the improvement comprising:

first latch means mounted at the distal end of the handle;

second latch means mounted at the proximal end of the handle; and third latch means mounted on the appliance for selective releasable engagement with said first and second latch means; and anti-rotation means coupling the appliance to the handle when said third latch means is respectively individually engaged with said first and second latch means.

26. A hammer comprising:

an elongate handle including a distal end and having a distal surface and a proximal end having a proximal surface;

a hammer head mounted at said distal end and including an end surface acting as a fulcrum, and a nail-pulling claw;

a first bore in said distal end including a non-circular cross section and extending into said handle from and substantially perpendicular to said distal surface;

a first shoulder in said first bore facing away from said distal surface;

a second bore including a noncircular cross section corresponding to that of said first bore and extending into said handle from and substantially to said proximal surface;

a second shoulder in said second bore facing away from said proximal surface; and a fulcrum extension member including a first surface, a fulcrum surface, and an attachment pin extending from said fulcrum extension member generally perpendicular to said first surface, said attachment pin including a noncircular cross-section complementary to that of said first and second bores and a free end, said attachment pin to be selectively received in said first bore to mount said body at said distal end to essentially lengthen the lever arm provided by said handle and move said fulcrum from said end surface to said fulcrum surface of said extension member, and in said second bore to store said fulcrum extension member at said proximal end of said handle, said non-circular cross sections. preventing rotation of said fulcrum extension member about said pin, and said pin including at least one yieldable member adjacent said free end to releasably latch against the respective shoulder of the respective bore.

27. The hammer of claim 26, and further comprising:

a non-circular sleeve in said first bore providing said non-circular cross section thereof.

28. The hammer of claim 26, and further comprising:

a non-circular sleeve in said second bore providing the non-circular cross section thereof.

29. The hammer of claim 26, and further comprising:

first and second non-circular sleeves respectively mounted in said first and second bores providing the respective non-circular cross sections thereof.

30. The hammer of claim 26, wherein:

said at least one yieldable member comprises a spherical element held captive in said pin, and spring means urging said spherical element radially outwardly, and recess means adjacent the distal ends of each of said sleeves each defining a detent for receiving said spherical element therein.

* * * * *